US006350958B1

(12) United States Patent
Taylor

(10) Patent No.: US 6,350,958 B1
(45) Date of Patent: Feb. 26, 2002

(54) MANUALLY OPERATED ACTUATING DEVICE AND METHOD

(75) Inventor: David G. Taylor, Thomasville, GA (US)

(73) Assignee: Taylor-Maddox Technical, Inc., Thomasville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/652,940

(22) Filed: Aug. 31, 2000

Related U.S. Application Data

(63) Continuation-in-part of application No. 09/447,164, filed on Nov. 22, 1999, now Pat. No. 6,130,391, which is a continuation of application No. 09/291,796, filed on Apr. 14, 1999, now Pat. No. 5,998,748.

(51) Int. Cl.[7] ..... H01H 33/04

(52) U.S. Cl. ..... 200/331; 200/17 R; 218/12; 337/168

(58) Field of Search ..... 81/53.1; 200/17 R, 200/331; 218/1, 12; 294/19.1, 19.3, 24, 26; 337/156, 168, 171, 194, 174–176, 202, 203, 208, 417, 211–214; 439/476.1, 480, 477, 478, 483, 484

(56) References Cited

U.S. PATENT DOCUMENTS 5,998,748 A * 12/1999 Taylor ..... 200/331
6,093,901 A * 7/2000 Taylor ..... 200/331
6,130,391 A * 10/2000 Taylor ..... 200/331

* cited by examiner

*Primary Examiner*—Michael Friedhofer
(74) *Attorney, Agent, or Firm*—Baker, Donelson, Bearman & Caldwell

(57) ABSTRACT

An actuating device (60) operated by a hookstick (4) is attached to a manually operated fused cutout switch (2) or a oil circuit recloser switch (14). The device (60) comprises a cantilever (62) with a pair of opposing hook-shaped receptacles (70, 72) for receiving a hookstick (4) that is used to alternatively open or close the switch. A method of actuating a manually operated switch is disclosed.

11 Claims, 5 Drawing Sheets

MANUALLY OPERATED ACTUATING DEVICE AND METHOD

This application is a continuation-in-part of application Ser. No. 09/447,164 filed Nov. 22, 1999, U.S. Pat. No. 6,130,391, as a continuation of Ser. No. 09/291,796 filed Apr. 14, 1999 issued Dec. 7, 1999 as U.S. Pat. No. 5,998,748.

INTRODUCTION

This invention relates to manually operated handles for recloser switches and lock outs on pole mounted circuit reclosers used by electric utilities. More particularly, this invention relates to a remotely operated actuating device for affixing to a shaft used to open and close a recloser switch using a hookstick.

BACKGROUND OF THE INVENTION

Commercial and residential electrical power is distributed through electric cables which run along a series of power poles. Many of the poles are strategically mounted with automatic circuit reclosers, which are recognized by electric utilities as essential for achieving an important goal of providing continuity of electric service simply and economically. Some 80 to 95 percent of all system faults on overhead power distribution systems are temporary in nature and last from only a few cycles to a few seconds. These temporary faults are generally caused by wind, lightning, animals, tree branches, and switching surges.

Reclosers sense and interrupt fault currents and automatically restore service after momentary outages by restoring current after the temporary fault condition is gone. If a fault is permanent, the recloser locks open after a preset number of operations and isolates the faulted section of the system from the main system.

Reclosers are mounted near the tops of utility poles and are provided with manually operated reclosing levers, also known as manual operating handles. The reclosing levers are used for manually opening and closing the recloser or setting the recloser to lockout after one operation. These manually operated levers are currently operated by a hand-held hookstick that is 30 to 40 feet in length. The hookstick is operated by utility worker either on a pole, in a bucket truck, or on the ground. The utility worker inserts the hookstick into a ring that extends from the end of the lever and is used to actuate the lever by pressing against the ring with the hookstick.

The prior art hookstick-operated levers are difficult and cumbersome to operate. Inserting the hookstick into the ring requires skill and patience. The difficulty of inserting the hookstick into the ring is further complicated by the conditions in which system faults generally occur. High winds and lightning are leading causes of system faults. Therefore, a need to operate a recloser lever often arises during poor weather and at nighttime. Placing the hookstick into a small ring at the top of a utility pole is even more arduous a task in wet, windy, and dark conditions which may cause numerous failed attempts and become time consuming. Time is of the essence in restoration of electrical power. Moreover, safety of utility personnel is a significant concern. Failed attempts to insert a hookstick into a ring increase the personnel's exposure to weather conditions or electrical hazards. The prior art fails to address these problems associated with the hookstick operated recloser lever.

SUMMARY OF THE INVENTION

Accordingly, the present invention solves the deficiencies found in prior art recloser levers operated by a hookstick and a ring-actuated lever. In particular, it is an object of the present invention to provide an effective means to make the operation of recloser levers with a hookstick easier and faster. The present invention accomplishes this goal by eliminating the need to exercise skill and patience in placing a hookstick into a ring actuator.

The present invention as disclosed herein is an improved actuator device for providing operational control of a recloser lever by a hookstick. The actuator device consists of an elongate cantilever member that is adapted to attach to the existing ring of the recloser lever, or to replace the existing recloser lever. Once the actuator device of the present invention is installed, the recloser lever may be actuated without finding and placing the hookstick into the ring. Instead, the improved actuator device will allow a user to engage the hookstick by receiving the hookstick in a receptacle of the cantilever and then moving the hookstick in the desired direction to open or close the recloser or adjust the lockout setting. Thus, the recloser lever may be actuated in a single attempt with less precision than needed for inserting the hookstick into a prior art ring. In a preferred embodiment, the receptacle defines at least one hook-shaped extension in a distal end position of the cantilever.

In another aspect, the present invention provides a method of actuating a manually operated recloser and lock-out switch mounted on poles of an overhead electrical power distribution system, comprising the steps of (a) attaching an elongate cantilever arm to a ring extending from a recloser and lock-out switch; (b) engaging a receptacle on the cantilever arm with a distal end portion of an elongated member; and (c) moving the cantilever arm from a first position to a second position in response to moving the elongated member, whereby the cantilever arm moves the recloser and lock-out switch between an open position and a closed position.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
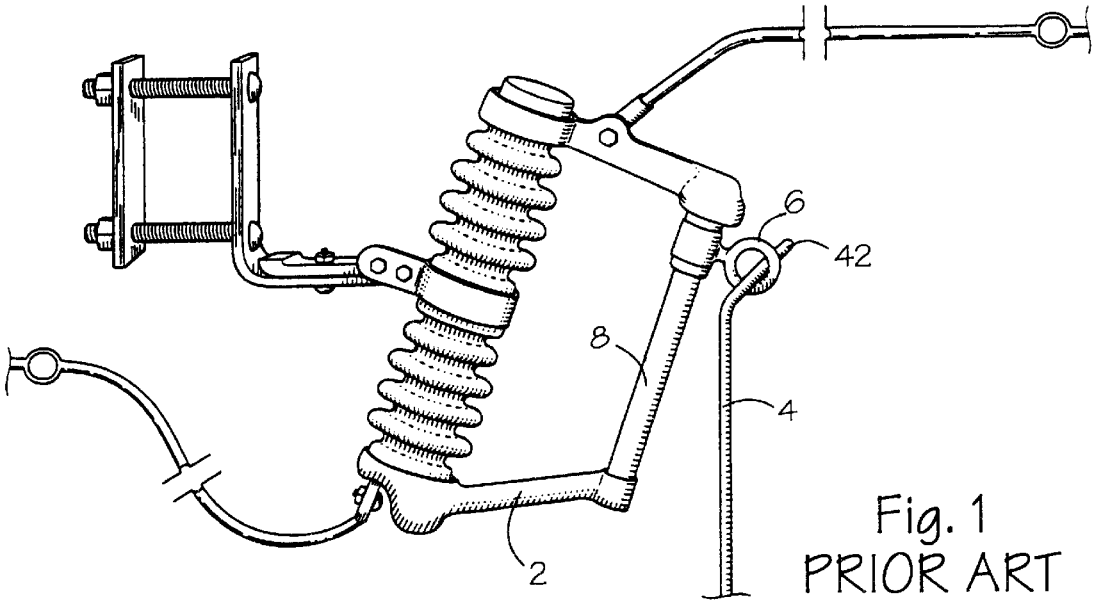
Fig. 1 PRIOR ART
FIG. 1 is a side view of the prior art cutout and arrester combination having a handle and ring manual operating switch.
Figure 8:
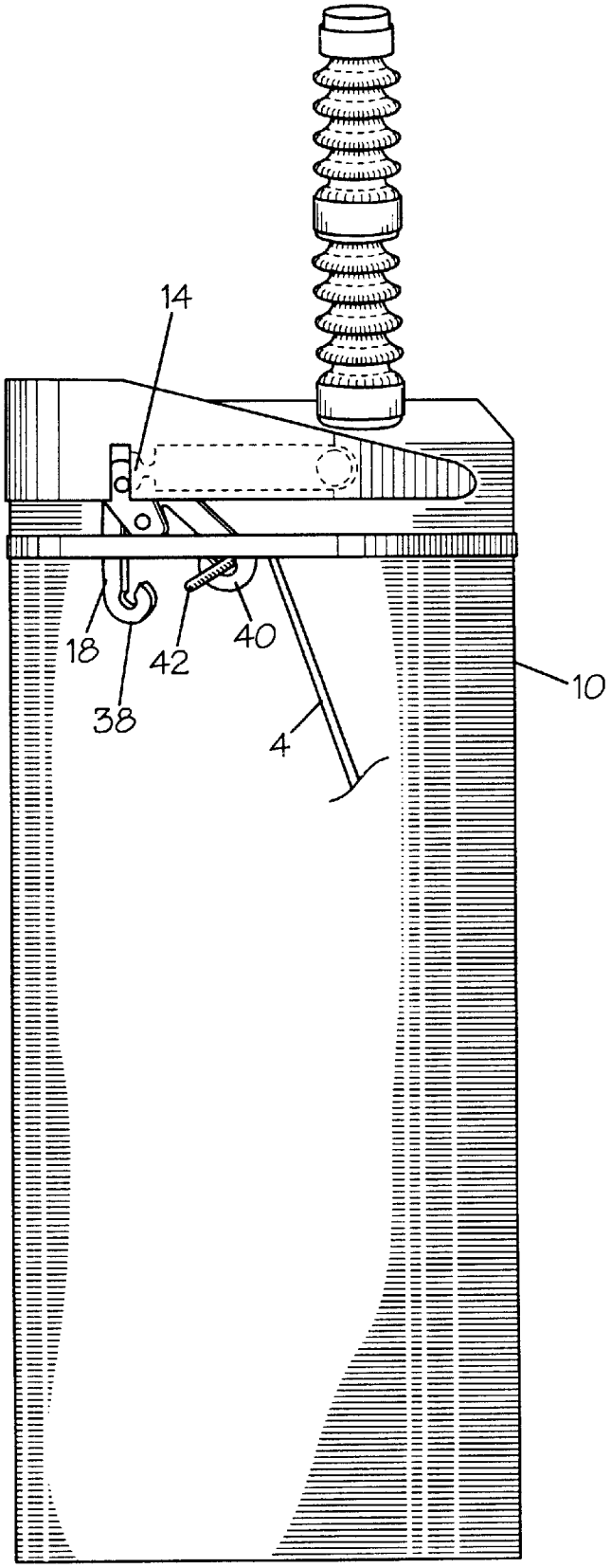
FIG. 8 is side view of the present invention shown attached to a single phase oil circuit recloser.

Referring to the drawings, FIG. 1 illustrates a cutout and arrester combination, also know as a lockout switch or fused cutout switch 2. As shown in FIG. 1, the fused cutout switch is generally operated by manually placing a hookstick 4 in a ring 6 and moving the ring to operate a handle 8 that is used to open or close the cutout switch. An equivalent method is used in the prior art in conjunction with oil circuit reclosers for manually operating a recloser switch. FIG. 8 depicts an oil circuit recloser 10, but with the present actuating device 12 attached thereto.

Figure 2:
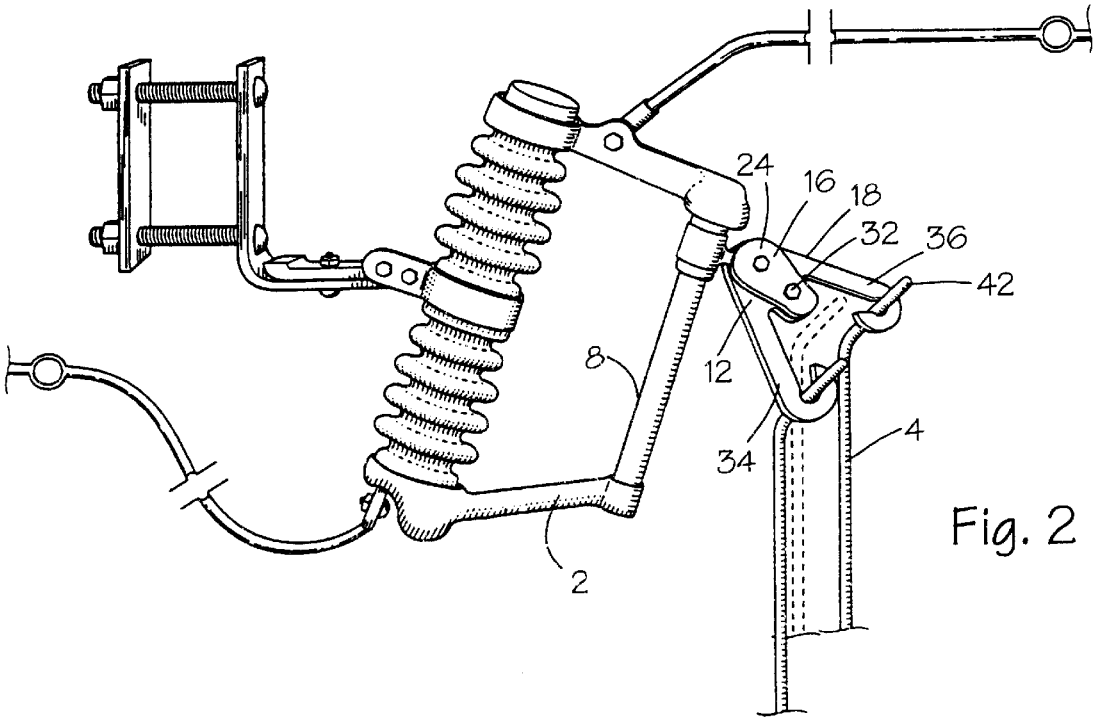
FIG. 2 is a side view of the present invention shown attached to the ring provided on a recloser cutout and arrester combination.

FIG. 2 illustrates a first variation of the actuating device 12 of the present invention as used on the cutout switch 2. In the embodiment shown in FIG. 2, the actuating device, is attached to the existing ring 6. The same hookstick 4 as used in the prior art is used to open and close the cutout switch by engaging the actuating device in alternate positions on the actuating device as shown in the figure. The ring is caused by the actuating device to move the handle 8 in the same manner as before to actuate the switch, however the switch is more conveniently accessed and operated using the present actuating device.

Figure 9:
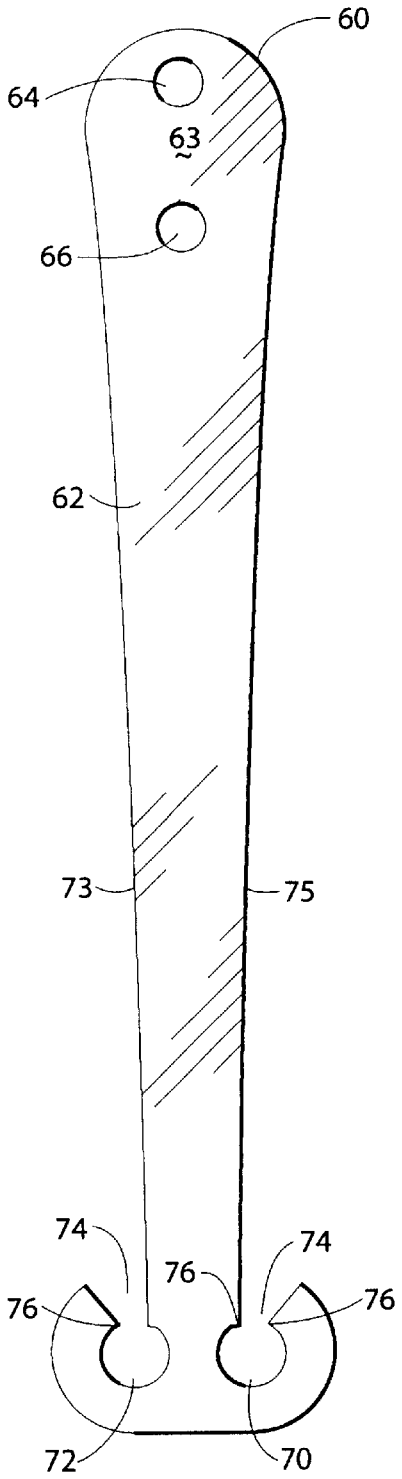
FIG. 9 is a front view of an alternate embodiment of the cantilever of the present invention.
Figure 10:
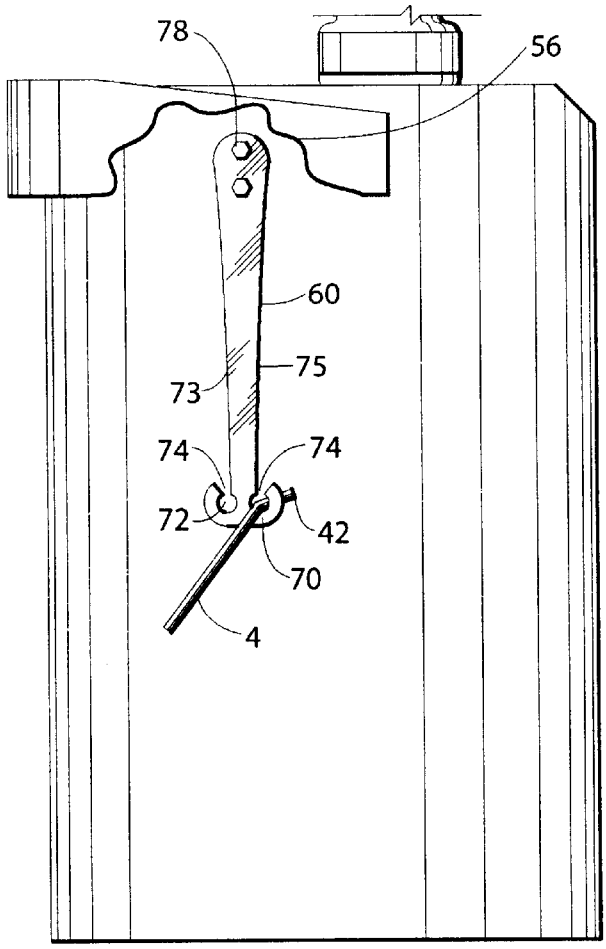
FIG. 10 is a view of the cantilever illustrated in FIG. 9, shown attached to a single phase oil circuit recloser.

As shown in FIG. 8, the present actuating device also may be used on an oil circuit recloser switch 14 having the same type of ring for engaging the hookstick. The actuating device is used on the oil circuit recloser switch in the same manner as described previously. FIGS. 9 and 10 illustrate a second variation and embodiment of the invention wherein the ring used by present reclosers is eliminated completely by adapting the present device to connect directly to the recloser.

Figure 3:
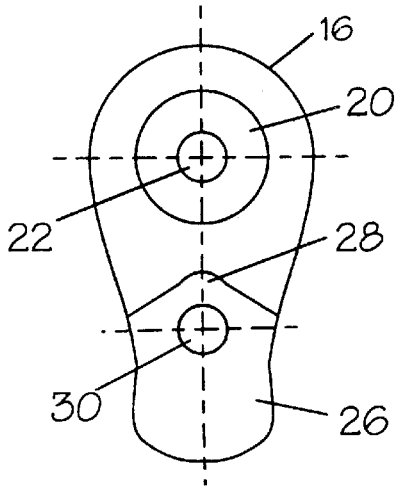
FIG. 3 is a front view of the ring clamp of the present invention.
Figure 4:
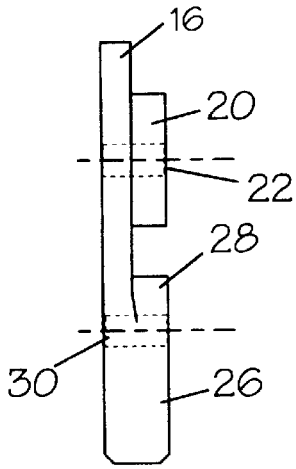
FIG. 4 is a side view of the ring clamp of the present invention.

In the first embodiment of the invention, the actuating device attaches to an existing ring 6 and comprises two primary parts that are bolted together on the ring 6 of a cutout switch 2 or recloser switch 14. The first part consists of a ring clamp 16 having a height of about 3 3/16 inches, and the second part consists of cantilever 18 having a height of about 6 3/8 inches. The ring clamp is shown in detail in FIG. 3 and FIG. 4.

The ring clamp 16 is about ¼ inch thick and has two raised members that increase the thickness of the clamp in those members another ¼ inch to about ½ inch. The first raised member 20 has a circular diameter and fits within the ring 6 such that the ¼ inch raised circular diameter is within the inner diameter of the ring. A first aperture 22 is provided in the first raised member for receiving a bolt 24. The second raised member 26 has a point 28 at the tip of an A-shaped shoulder that bears against the outer diameter of the ring when the clamp is attached to the cantilever 18. A second aperture 30 is provided in the second raised member for receiving a bolt 32.

Figure 5:
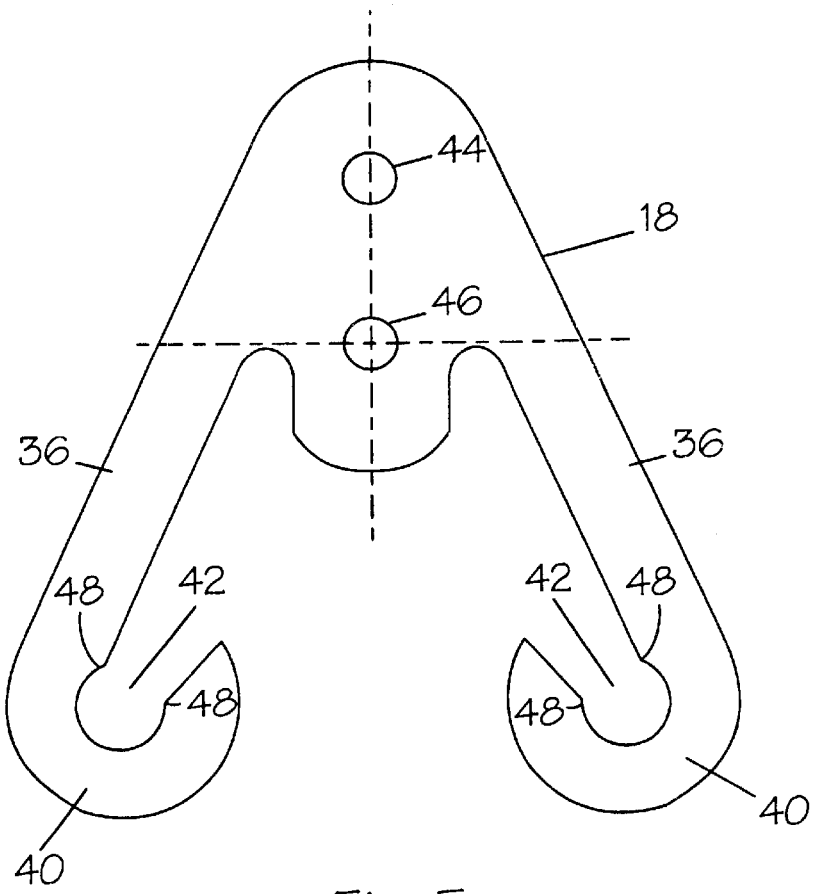
FIG. 5 is a front view of the cantilever of the present invention.
Figure 6:
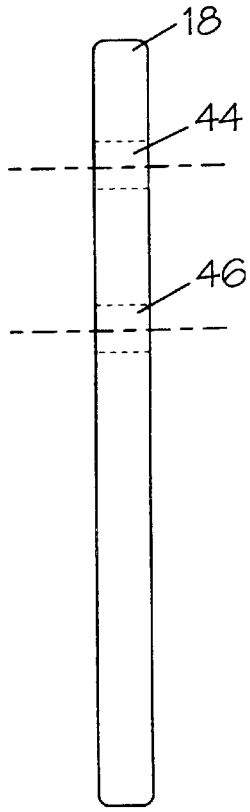
FIG. 6 is a side view of the cantilever of the present invention.

The second part or cantilever 18 is shown in FIGS. 5 and 6. The cantilever part is A-shaped and includes a first lever arm 34 and a second lever arm 36 that oppose each other at an angle. In the embodiment shown, the lever arms are at an acute angle of about 25 degrees to 35 degrees with respect to each other. Each lever arm terminates in a curved hook-shaped receptacle 38 and 40 for receiving a limb 42 at the top of a hookstick 4 like that commonly used to actuate recloser switches. The hook-shaped receptacles each include a receiving slot sized such that the hookstick limb fits into the receptacle. Slight lips 48 may be provided on the receptacles on each side of the receiving slots to hinder the hookstick limb from slipping out of the receptacle while the actuating device 12 is operated.

Figure 7:
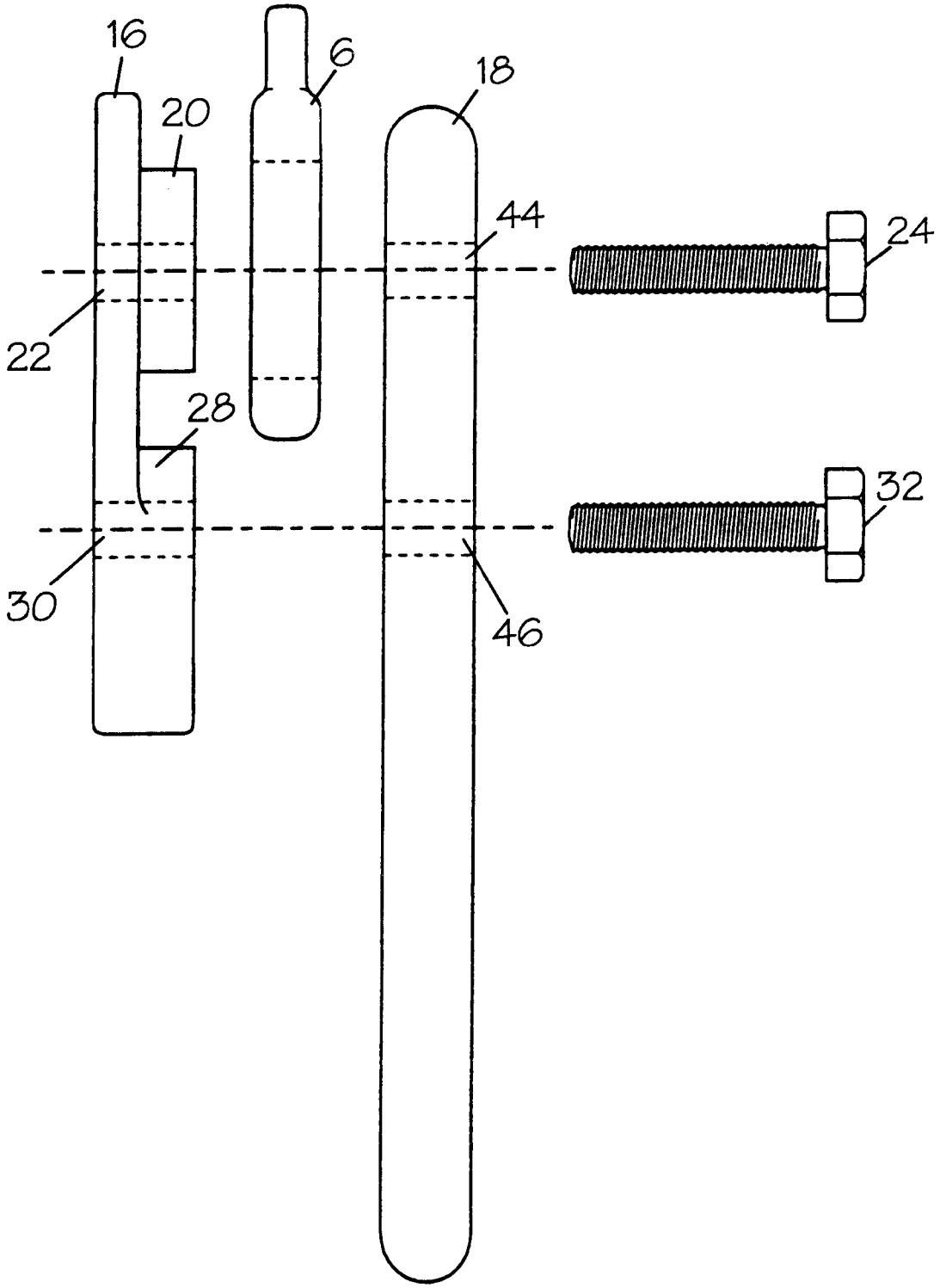
FIG. 7 is an exploded side view of the present invention in relation to the prior art ring.

Apertures 44 and 46 are provided in the cantilever 16. These apertures in the cantilever align with the apertures 22 and 30 on the ring clamp 16. The bolts 24 and 32 are inserted through the apertures of both the cantilever and ring clamp for joining the parts together about a ring 6 as shown in FIG. 7. In lieu of a pair of bolts, a u-bolt or other retaining means could be used for securely attaching the parts to the ring. After the device is attached to the ring, the limb 42 of a standard hookstick 4 is inserted into the receiving slots of the cantilever and the limb is pressed against one of the hook-shaped receptacles 38 or 40 to move the cantilever. As the cantilever is moved, the straight edges of the second raised member 26 of the ring clamp bear against the ring and the cantilever operates the ring 6 and handle 8 to open and close the recloser switch 14 or cutout switch 2.

FIG. 8 depicts the recloser switch lever 50 within the cover 52 in the up position parallel to the top of the recloser cylinder 54. The up position shown in FIG. 8 signifies that the recloser switch is closed. In FIG. 8 the hookstick 4 is shown engaging the actuating device 12 to move switch lever 50 to the down position. The down position is illustrated by the position of the switch lever 50 in FIG. 10 and signifies that the recloser switch is open, which causes the recloser circuit to be open.

FIGS. 9 and 10 illustrate an alternate embodiment 60 of a cantilever actuator device according to the present invention for attaching to a ring 6 of a cutout switch 2 or for attaching directly to an oil circuit recloser switch 14. As shown in front view, the cantilever 60 comprises an elongate, preferably planar, member 62 that defines in a planar surface 63 in a first portion a pair of apertures 64, 66. The apertures 64, 66 are spaced for aligning with the apertures 22, 30 in the clamp ring 16. An opposing distal end portion 68 defines a pair of opposing receptacles 70, 72. In the illustrated embodiment, the receptacles 70, 72 define hook-shaped extensions from the member 62. The receptacles 70, 72 open with gaps or slots 74 outwardly laterally of the member 62. The slots 74 are sized for receiving the limb 42 at the top of the hookstick 4. Slight lips 76 may be provided on the receptacles 70, 72 on opposing sides of the receiving slots 74 to hinder the hookstick 4 from slipping out of the receptacle 70, 72 while the acutating device or cantilever 60 is moved to operate the switch to which the cantilever is attached. The opposing sides 73, 75 of the member 62 define contact surfaces for guiding the end of the hookstick 6 to the receiving slots 74 and into the receptacle 70, 72.

The cantilever 60 is attached to the ring 6 as discussed above, with the bolts 24, 32 inserted through the apertures 22, 30 of the clamp ring 16 and the aligned apertures 64, 66 of the cantilever. As illustrated in FIG. 10, the cantilever 60 may also be attached to a threaded hole at the end of a shaft 78 or other linking member that communicates with a switching mechanism within the recloser cylinder 10 to cause the recloser circuit to open and close.

The cantilever 60 actuates the switch by sliding the tip or limb 42 of the hookstick 4 along the respective contact surface 73, 75. The limb 42 of the hookstick 4 is guided longitudinally therealong into and through the slot 74 into the respective receptacle 70, 72. The limb 42 is pressed against the inner wall of the receptacle 70, 72 to move the cantilever 60. As the cantilever 60 is moved, the switch to which the cantilever is connected likewise moves, in order to operate the switch to either open or close the switch, depending on moving the hookstick 4 in a first direction or a second opposing direction. The opposing receptacles 70, 72 facilitate the lateral positioning of the hookstick for operating the cantilever. An alternate embodiment provides only one receptacle at the distal end.

While various embodiments of actuating devices of the present invention have been shown in the drawings and described, variations in the invention's embodiments and practice will be readily apparent to those persons skilled in the art. Therefore, the invention should not be construed as limited to the specific form shown and described, but instead is as set forth in the following claims.

What is claimed is:

1. An actuating device for attachment to an operating member of a manually operated switch, comprising:

an elongate cantilever;

means for attaching said cantilever to said operating member; and said cantilever including at least one receptacle at a distal end portion for receiving a hookstick, whereby said hookstick moves said actuating device to alternatively open or close said switch.

2. The device of claim 1, wherein said one receptacle of said cantilever is a first one in a pair of receptacles in opposing relation.

3. The device of claim 2, wherein said pair of receptacles open in opposing lateral directions outwardly of the cantilever.

4. The device of claim 3, wherein the receptacles define hook-shaped extensions.

5. The device of claim 1 wherein said one receptacle is a hook-shaped extension.

6. The device of claim 1, wherein said actuating device is attached to the operating member of an oil circuit recloser switch.

7. The device of claim 1, wherein said actuating device is attached to a ring of a fused cutout switch.

8. The device of claim 1, wherein said means for attaching said cantilever to said operating member includes a clamp having a first raised member and a second raised member, said first raised member disposed within said ring, and a means for attaching said first raised member and said second raised member of said clamp to said cantilever.

9. A method of actuating a manually operated switch mounted on poles of an overhead electrical power distribution system, comprising the steps of:

(a) attaching an elongate cantilever arm to a operating member of a manually operated switch;

(b) engaging a receptacle at a distal end portion of the cantilever arm with a distal end portion of an elongated member; and (c) moving the cantilever arm from a first position to a second position in response to moving the elongated member, whereby the cantilever arm moves the switch between an open and closed position.

10. The method as recited in claim 9, wherein step (a) attaching the cantilever arm to a ring extending from a recloser and lock-out switch, comprises:

providing a clamp having an annular portion received within the ring and a bearing portion bearing against an exterior side of the ring; and securing the cantilever arm to the clamp in an overlying relation to the ring, whereby the ring is sandwiched between the clamp and the cantilever arm.

11. The method as recited in claim 9, wherein step (b) comprises moving the distal end of the elongate member into a hook-shaped receptacle at a distal end of the cantilever arm.

* * * * *